US010535329B2

(12) United States Patent
Berg

(10) Patent No.: US 10,535,329 B2
(45) Date of Patent: Jan. 14, 2020

(54) MAGNETICALLY LATCHED SPRING ASSISTED BUILT-IN GUITAR STAND

(71) Applicant: Sean Michael Berg, Rice Lake, WI (US)

(72) Inventor: Sean Michael Berg, Rice Lake, WI (US)

( * ) Notice: Subject to any disclaimer, the term of this patent is extended or adjusted under 35 U.S.C. 154(b) by 127 days.

(21) Appl. No.: 15/691,713

(22) Filed: Aug. 30, 2017

(65) Prior Publication Data

US 2018/0061380 A1 Mar. 1, 2018

Related U.S. Application Data

(60) Provisional application No. 62/381,607, filed on Aug. 31, 2016.

(51) Int. Cl.
*G10G 5/00* (2006.01)
*G10D 1/08* (2006.01)

(52) U.S. Cl.
CPC ..... *G10G 5/00* (2013.01); *G10D 1/085* (2013.01)

(58) Field of Classification Search
CPC ..... G10D 1/085; G10G 5/00
USPC ..... 84/291, 327; 248/121, 127, 166, 170, 248/206.5, 309.4, 371, 372.1, 683
See application file for complete search history.

(56) References Cited

U.S. PATENT DOCUMENTS

| | | | | |
|---|---|---|---|---|
| 4,592,265 | A * | 6/1986 | Steinberger | G10G 5/005 84/327 |
| 4,693,161 | A * | 9/1987 | Uhrig | G10G 5/00 84/291 |
| 5,197,701 | A * | 3/1993 | Olson | G10G 5/00 248/166 |
| 6,422,522 | B1 * | 7/2002 | Woollen | G10G 5/00 211/85.6 |
| 8,637,752 | B2 * | 1/2014 | Innocenti | G10G 5/00 224/250 |
| 2004/0182984 | A1 * | 9/2004 | Sandkuhl | G10G 5/00 248/443 |
| 2015/0340020 | A1 * | 11/2015 | Noska | G10G 5/00 84/327 |
| 2017/0316764 | A1 * | 11/2017 | Snyder | G10D 1/08 |
| 2018/0061380 | A1 * | 3/2018 | Berg | G10D 1/085 |
| 2018/0137841 | A1 * | 5/2018 | Mahmoud | G10D 1/08 |

OTHER PUBLICATIONS

Facebook.com. (2013). Bergstok. [online] Available at: https://www.facebook.conn/bergstok/photos/a.572324022835258/572336589500668/?type=3&theater [Accessed Mar. 1, 2019]. (Year: 2013).*

* cited by examiner

*Primary Examiner* — Joshua E Rodden
(74) *Attorney, Agent, or Firm* — Michael R Shevlin

(57) ABSTRACT

The present invention discloses a magnetically latched, spring assisted, built-in guitar stand that is built in to a guitar to provide quick standing of the guitar without the need for a separate guitar stand. The magnetically latched, spring assisted, built-in guitar stand consists of a stand arm that pivots away from the guitar when opened to form a tripod-like footprint that allows the guitar to stand by itself. The reduced footprint of the guitar stand allows the guitar to stand in a relatively small area.

14 Claims, 5 Drawing Sheets

MAGNETICALLY LATCHED SPRING ASSISTED BUILT-IN GUITAR STAND

CROSS-REFERENCE TO RELATED APPLICATIONS

This application claims priority from U.S. Provisional Patent Application No. 62/381,607, filed on Aug. 31, 2016, the contents of which is incorporated herein by reference.

FIELD

The present invention relates to field of musical instruments, specifically a guitar stand that is built in to a guitar to provide quick standing of the guitar without the need for a separate guitar stand.

BACKGROUND

Typical guitars use a conventional stand. Instead of a conventional stand, some prior art solutions have used a stand that is attached to the guitar that may be folded flat when in use, and then opening for use as a stand. For example, the 1963 Guild Thunderbird guitar uses a guitar stand that is bolted to the guitar body. The stand was made of metal and magnets in the guitar body held it closed. One drawback was the guitar body had to be shaped such that it would form two of three legs of a tripod, which limited the guitar shape.

It would be desirable to have convenient stand built into a guitar or other stringed instrument.

SUMMARY OF THE INVENTION

The present invention discloses a discloses a magnetically latched, spring assisted, built-in guitar stand that is built in to a guitar to provide quick standing of the guitar without the need for a separate guitar stand. The magnetically latched, spring assisted, built-in guitar stand consists of a stand arm that pivots away from the guitar when opened to form a tripod-like footprint that allows the guitar to stand by itself.

The present invention provides reduced footprint of the guitar stand allows the guitar to stand in a relatively small area.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE DRAWINGS

The present embodiments may be understood from the following detailed description when read in conjunction with the accompanying figures. It is emphasized that the various features of the figures are not necessarily to scale. On the contrary, the dimensions of the various features may be arbitrarily expanded or reduced for clarity.

DETAILED DESCRIPTION

Embodiments of the invention will now be described with reference to the figures, wherein like numerals reflect like elements throughout. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Overview

Figure 1:
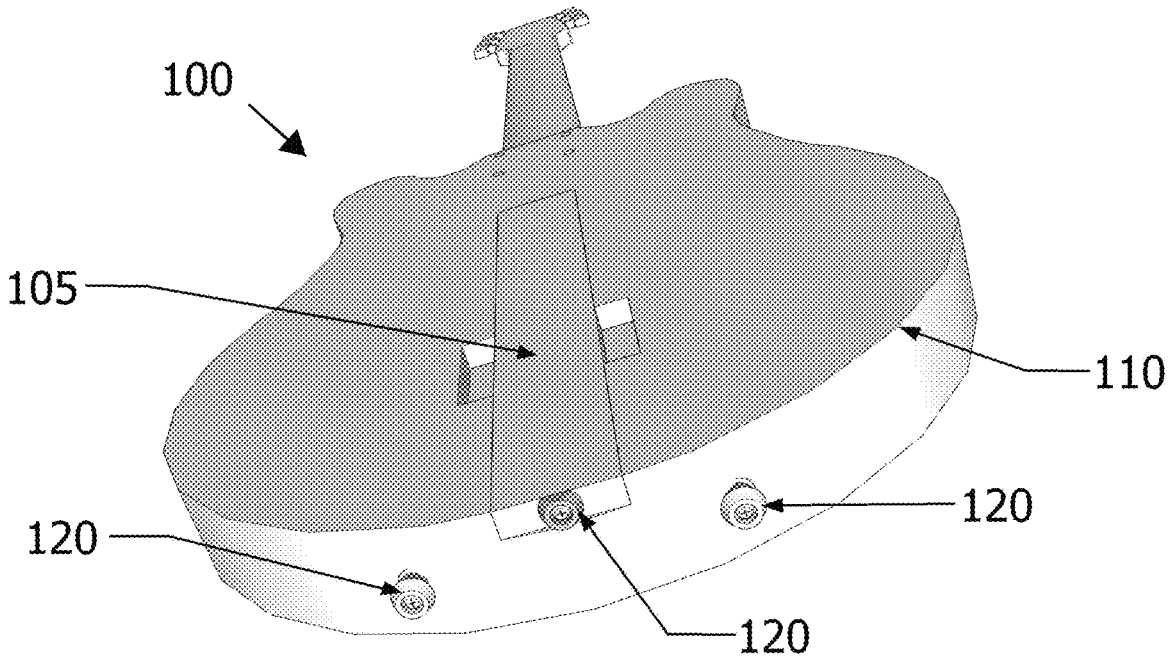
FIG. 1 shows one embodiment of a magnetically latched, spring assisted, built-in guitar stand in the closed position.
Figure 2A:
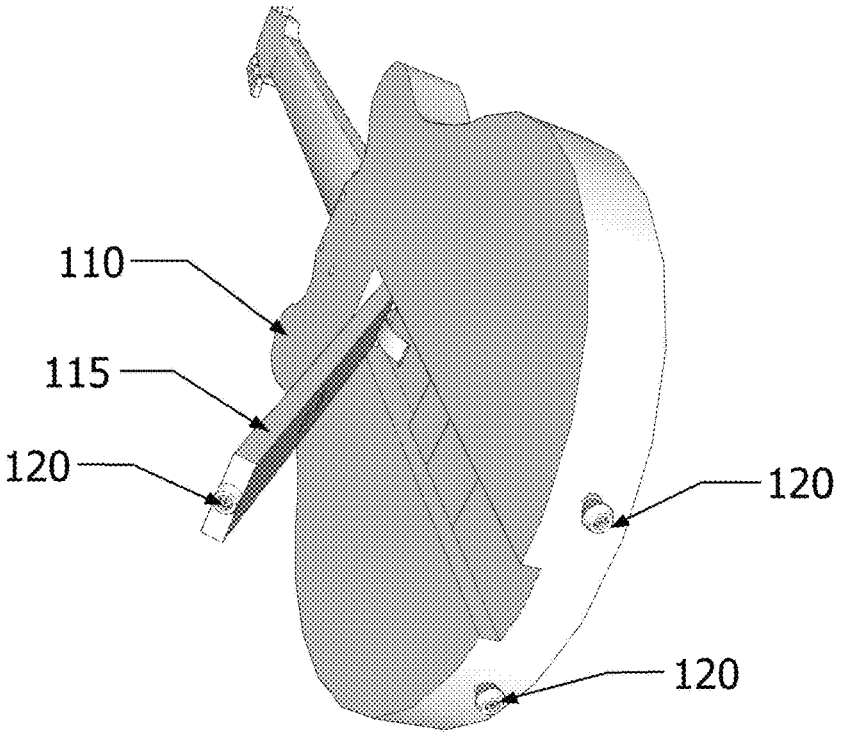
FIGS. 2A and 2B show the magnetically latched, spring assisted, built-in guitar stand of FIG. 1 in the open position.
Figure 2B:
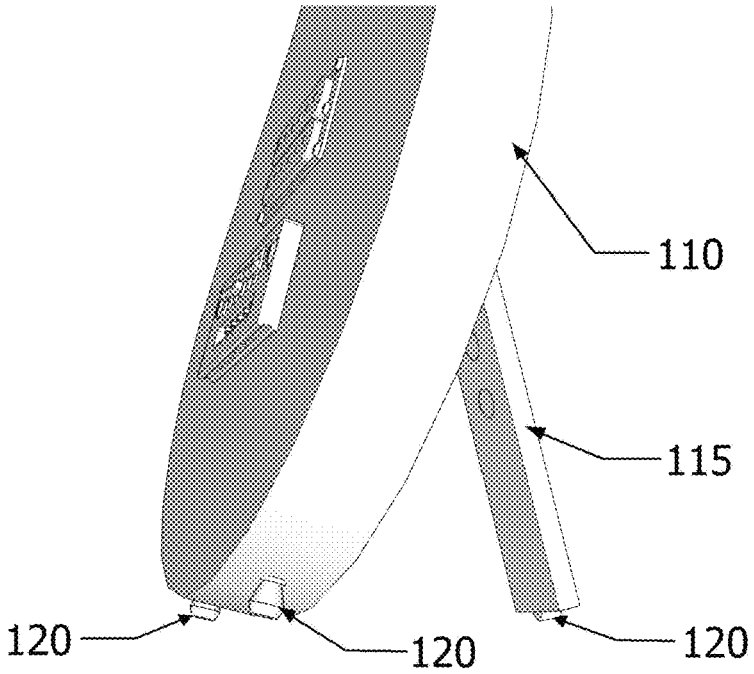

FIGS. 1, 2*a* and 2*b* are views showing one embodiment of a guitar 100 having a magnetically latched, spring assisted, built-in guitar stand 105 that is built in to a guitar 110 to provide quick standing of the guitar without the need for a separate guitar stand. The magnetically latched, spring assisted, built-in guitar stand 105 consists of a stand arm 115 that pivots away from the guitar 110 when opened to form a tripod-like footprint that allows the guitar to stand by itself. One advantage of the stand is the reduced footprint of the guitar stand which allows the guitar to stand in a relatively small area.

In some instances, a single leg stand arm to form a tripod could allow the guitar to top over and break the neck or headstock of the guitar. While the present figures show a tripod configuration, there are other configurations with more than three feet or legs. For example, in some embodiments the stand may have more than one leg, such as two legs, so the guitar body and stand would have four legs, which may make the guitar more stable when standing.

Figure 3A:
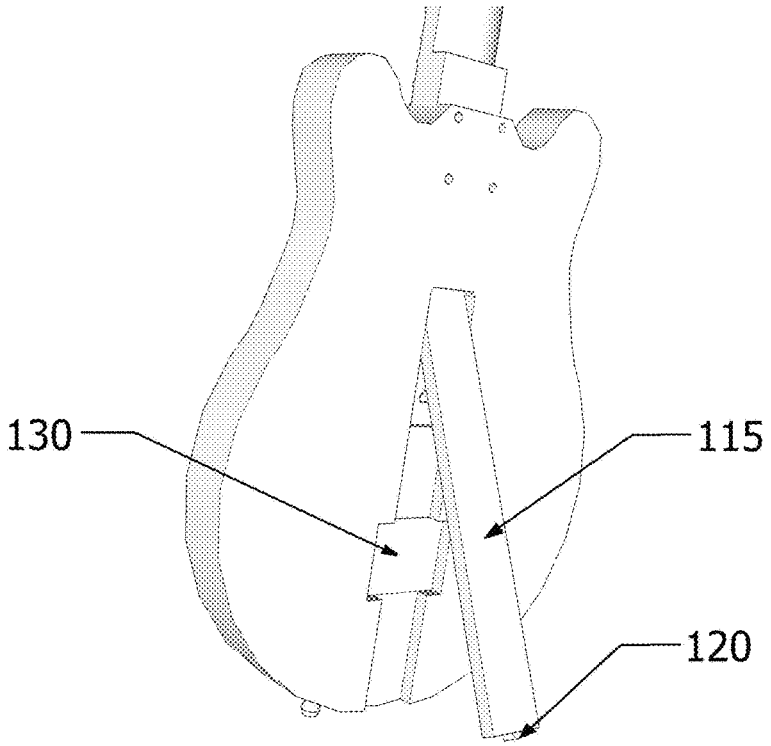
FIGS. 3A-3C show details of a magnetically latched, spring assisted, built-in guitar stand.
Figure 3B:
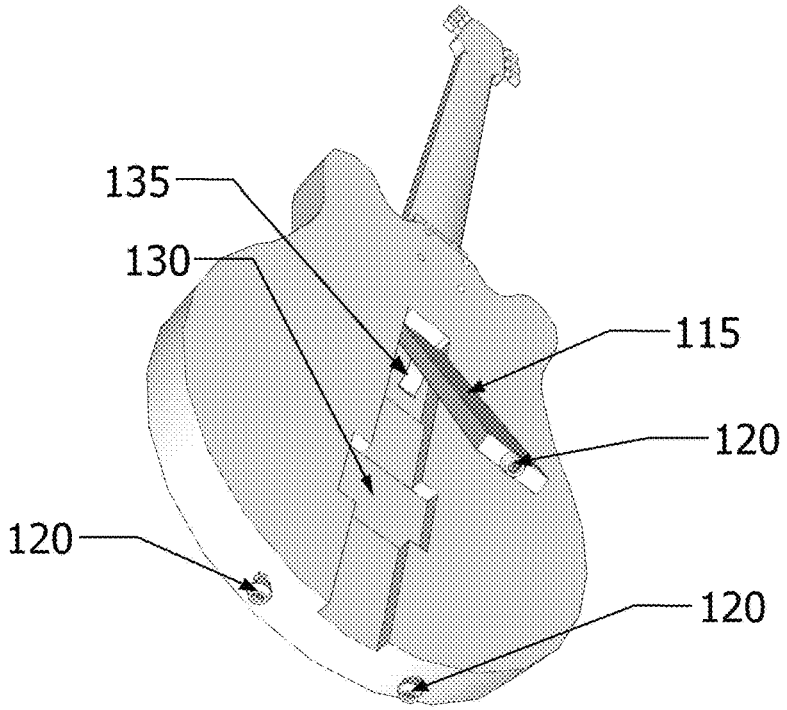
Figure 3C:
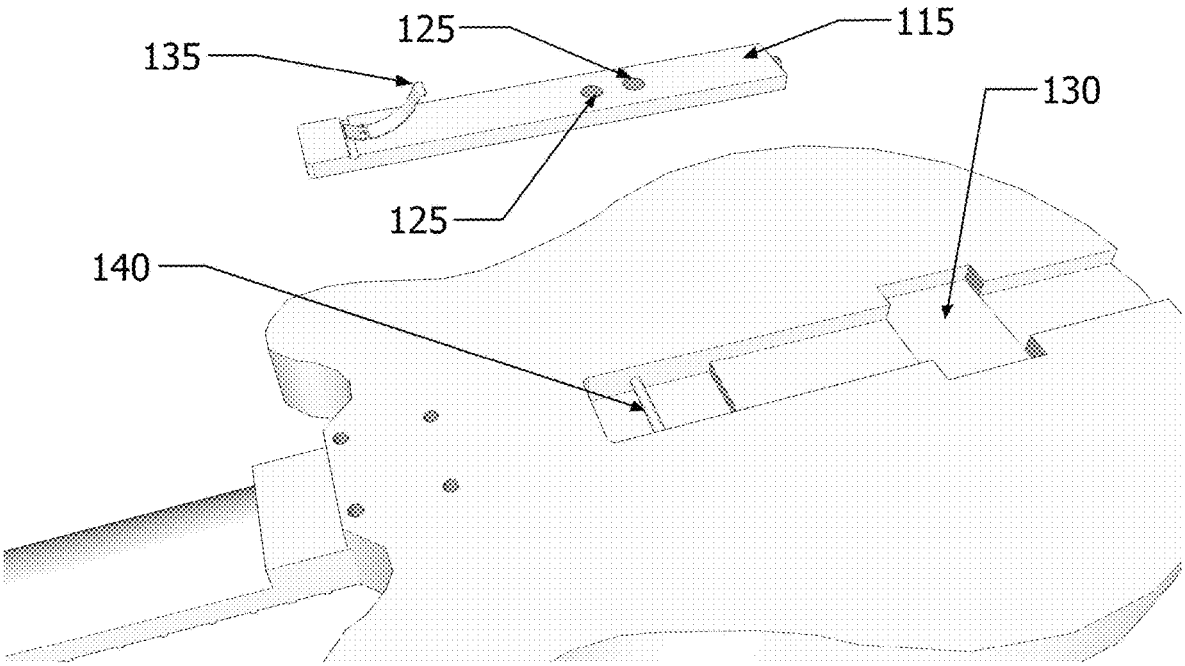

FIGS. 3A-3C shows details of a magnetically latched, spring assisted, built-in guitar stand. Stand feet 120, made of rubber or other suitable material, are mounted at the bottom edge of the guitar 110 and stand arm 115 to prevent slippage. In some embodiment, the strap buttons may be utilized two of the feet of the stand.

When the stand 105 is closed (FIG. 1), one or more stand latching magnets 125 in the stand arm 115 contact a steel latch plate 130 on the guitar to keep the stand 105 closed for normal guitar usage. When the stand 105 is opened, a pivot latch spring 135 mounted on the stand arm 115, connected to the pivot pin 140 installed in the guitar body, pushes the stand arm 115 out and holds it fully open. In some embodiments the plate 130 may be utilized as electronics access cover on the back of the guitar that the magnets in the stand are attracted to, and since the plate/cover is metal it also becomes an additional electronics shielding area for the guitar.

The pivot latch spring 135 also forms part of the pivot, and holds the stand arm 115 to the pivot pin 140. This setup also allows the stand arm 115 to be quickly removed from the guitar 110 simply by pulling it away from the body with moderate force. Note that depending on the implementation, the stand feet mounted on the guitar can double as pins (buttons) for a guitar strap. Note also that depending on the application, the steel latch plate 130 can double as an access cover for guitar electronics.

Guitar Stand Components

Figure 4:
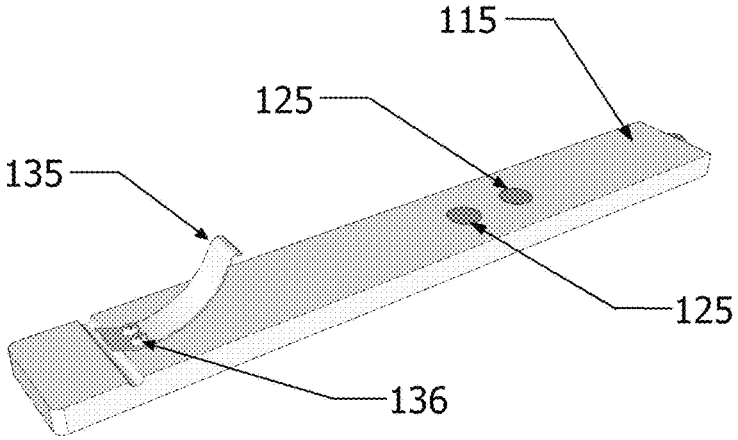
FIG. 4 shows a magnetically latched, spring assisted, built-in guitar stand detached from the guitar.
Figure 5:
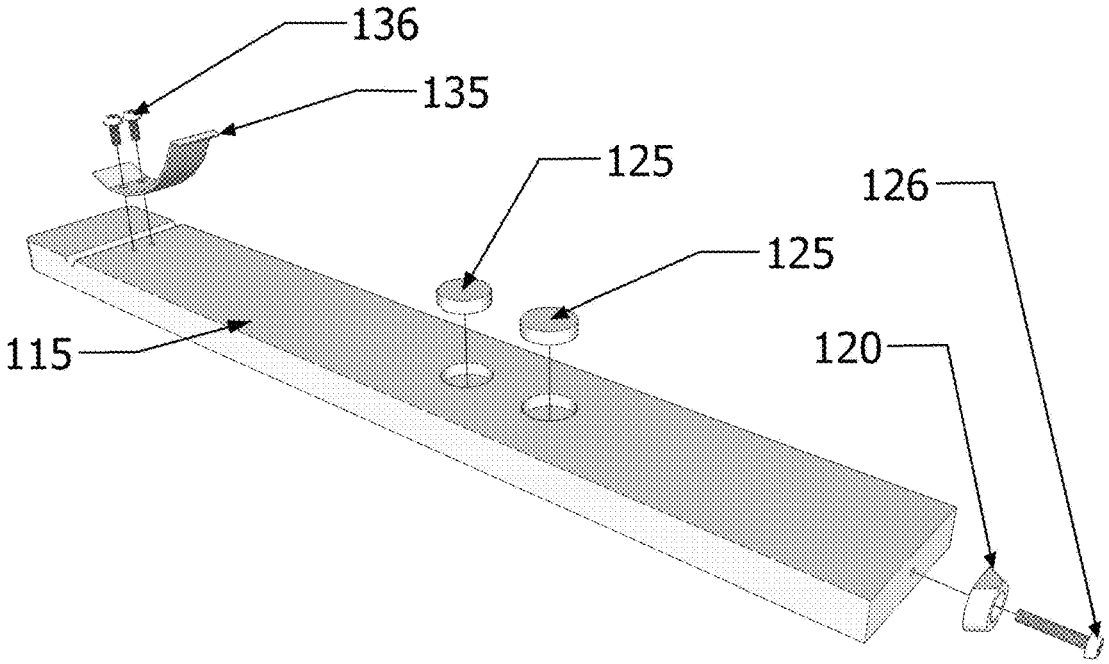
FIG. 5 shows the components of the magnetically latched, spring assisted, built-in guitar stand.

FIG. 4 shows an assembled magnetically latched, spring assisted, built-in guitar stand detached from the guitar and FIG. 5 shows the components of the magnetically latched, spring assisted, built-in guitar stand. The magnetically latched, spring assisted, built-in guitar stand consists of the following components:

One Stand Arm 115;

One Pivot Latch Spring 135;

Two Spring Mounting Screws 136;

A rubber stand foot 120;

A stand foot mounting screw 126;

One (or more) Stand Latching Magnets 125.

FIG. 4 shows an assembled magnetically latched, spring assisted, built-in guitar stand detached from the guitar and FIG. 5 shows the components of the magnetically latched, spring assisted, built-in guitar stand. The magnetically latched, spring assisted, built-in guitar stand consists of the following components:

Guitar Body Components

Figure 6:
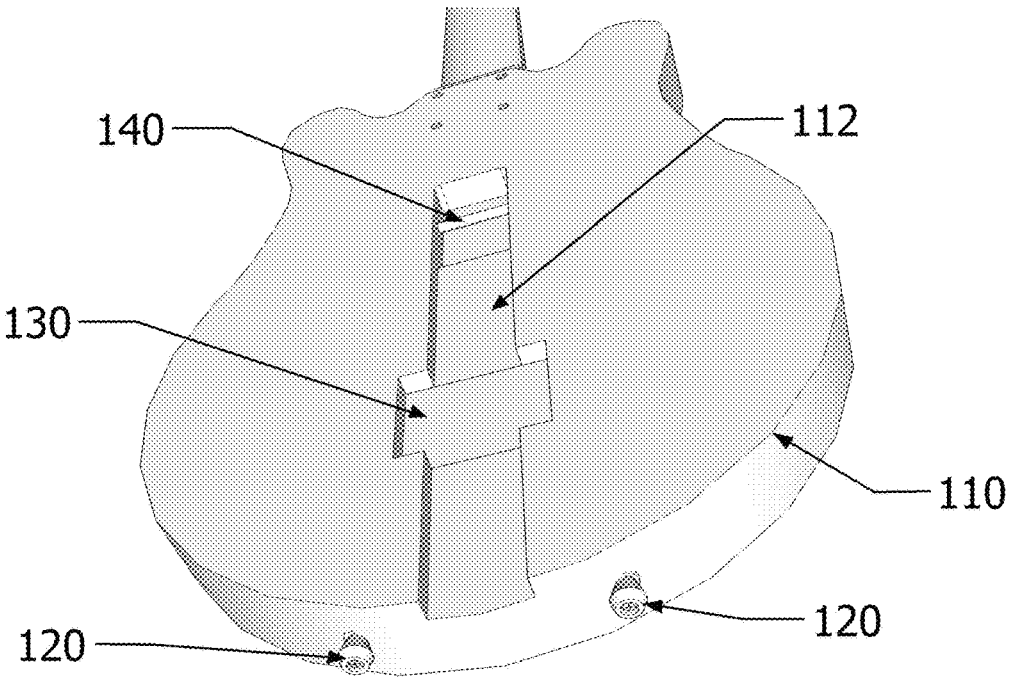
FIG. 6 shows the components of a guitar body that uses the magnetically latched, spring assisted, built-in guitar stand.

FIG. 6 shows one embodiment of a guitar body 110 showing a cavity 112 that is sized to accept the stand 105. Also included are the following components:

One Pivot Pin 140;

One Steel Latch Plate 130;

Two Rubber (or suitable material) Stand Feet 120;

Two Foot Mounting Screws 126.

In other embodiments, there may not be a cavity and the stand mounts to a surface.

While embodiments and applications of this invention have been shown and described, it would be apparent to those skilled in the art that many more modifications than mentioned above are possible without departing from the inventive concepts herein. It is to be understood that the present disclosure is illustrative only and that changes, variations, substitutions, modifications and equivalents will be readily apparent to one skilled in the art and that such may be made without departing from the spirit of the invention as defined by the following claims.

The invention claimed is:

1. A magnetically latched, spring assisted, built-in guitar stand comprising:

a stand arm having a top end and a bottom end;

a pivot latch spring mounted near the top end of the stand arm, the pivot latch spring and stand arm configured to engage a pivot pin on a guitar body to form a stand arm pivot, the pivot latch spring being further configured to spring assist in moving the stand arm to an open position; and one or more stand latching magnets mounted on the stand arm configured to magnetically couple with a metal plate on the guitar body and magnetically latch the stand arm to the guitar body in a closed position, wherein the metal plate is an electronics access cover;

wherein the stand arm is configured to pivot from the magnetically latched closed position to the spring assisted open position.

2. The guitar stand of claim 1, wherein the pivot latch spring is further configured to hold the stand arm in the open position.

3. The guitar stand of claim 1, wherein the engagement with the pivot pin is a removable engagement configured for quick removal of the stand arm from the guitar body by pulling it away from the body with moderate force.

4. The guitar stand of claim 1, further comprising one or more stand feet on the bottom end.

5. The guitar stand of claim 4, wherein the stand feet are guitar strap buttons.

6. The guitar stand of claim 1, wherein in the open position, the stand arm allows the guitar to stand by itself.

7. A guitar with built-in guitar stand comprising:

a guitar body having a stand cavity with a pivot pin; and a stand arm sized to fit in the stand cavity, the stand arm configured to be removably coupled with the pivot pin and pivot from a closed position within the cavity to an open position; wherein the guitar body further includes a metal plate and the stand arm further includes one or more latching magnets configured to engage the metal plate and hold the stand arm in the closed position, wherein the metal plate is an electronic access cover.

8. The guitar of claim 7, further comprising a pivot latch spring mounted on the stand arm, the pivot latch spring and stand arm configured to engage the pivot pin to form a stand arm pivot, the pivot latch spring being further configured to assist in moving the stand arm to the open position.

9. The guitar of claim 8, wherein the pivot latch spring is further configured to hold the stand arm in the open position.

10. The guitar of claim 7, wherein the guitar body further includes one or more stand feet positioned along a bottom edge of the body and the stand arm further includes one or more stand feet positioned along a bottom edge of the stand arm.

11. The guitar of claim 10, wherein the stand feet are guitar strap buttons.

12. A guitar with magnetically latched, spring assisted, built-in guitar stand comprising:

a guitar body having a stand cavity with a pivot pin and magnetic plate; and a guitar stand sized to fit in the stand cavity comprising:

a stand arm having a top end and a bottom end;

a pivot latch spring mounted near the top end of the stand arm, the pivot latch spring and stand arm configured to engage the pivot pin to form a stand arm pivot, the pivot latch spring being further configured to spring assist in pivoting the stand arm to an open position; and one or more stand latching magnets mounted on the stand arm configured to magnetically couple with the metal plate and magnetically latch the stand arm in a closed position in the cavity, wherein the metal plate is an electronics access cover;

wherein the guitar stand is configured to pivot from the magnetically latched closed position to the spring assisted open position.

13. The guitar of claim 12, wherein the guitar body further includes one or more stand feet positioned along a bottom edge of the body and the stand arm further includes one or more stand feet positioned on the bottom end of the stand arm.

14. The guitar of claim 13, wherein the stand feet are guitar strap buttons.

* * * * *